US006164898A

United States Patent [19]

Taylor

[11] Patent Number: 6,164,898

[45] Date of Patent: Dec. 26, 2000

[54] MANHOLE COVER REMOVAL APPARATUS AND METHOD

[76] Inventor: Richard J. Taylor, 10735 E. Sahuaro Dr., Scottsdale, Ariz. 85259

[21] Appl. No.: 09/010,049

[22] Filed: Jan. 21, 1998

[51] Int. Cl.[7] ..... B66C 1/06

[52] U.S. Cl. ..... 414/540; 212/166; 294/65.5; 414/541; 414/589

[58] Field of Search ..... 414/540, 541, 414/549, 550, 555, 589, 590, 737, 812, 542, 543, 684.3, 472; 212/166; 294/65.5; 296/50, 146.8

[56] References Cited

U.S. PATENT DOCUMENTS

| | | | |
|---|---|---|---|
| 2,239,750 | 4/1941 | Weeks et al. . | |
| 2,535,961 | 12/1950 | Schutt | 294/65.5 X |
| 2,622,750 | 12/1952 | Ehlers . | |
| 3,557,967 | 1/1971 | Madole | 414/555 X |
| 4,162,471 | 7/1979 | Peace et al. . | |
| 4,225,171 | 9/1980 | Hay, II et al. . | |
| 4,323,329 | 4/1982 | Chlad . | |
| 4,659,276 | 4/1987 | Billett | 414/543 |
| 5,035,336 | 7/1991 | Schmitz et al. | 212/166 |

FOREIGN PATENT DOCUMENTS

| | | | |
|---|---|---|---|
| 408775 | 1/1991 | European Pat. Off. | 294/65.5 |
| 2499049 | 8/1982 | France | 294/65.5 |
| 41946 | 2/1990 | Japan | 212/166 |
| 2045206 | 10/1980 | United Kingdom | 212/166 |

*Primary Examiner*—James W. Keenan
*Attorney, Agent, or Firm*—Parsons & Goltry; Robert A. Parsons; Michael W. Goltry

[57] ABSTRACT

In a vehicle of a type including a body carried by a wheeled chassis and a metallic manhole cover removably mounted with a hole accessing an enclosure, an apparatus for removing the manhole cover, the apparatus comprising a gripping member carried by the vehicle for movement in reciprocal directions between a first position to grasp the manhole cover and a second position to remove the manhole cover from the hole, and a drive assembly mounted with the vehicle and the gripping member for moving the gripping member in reciprocal directions.

12 Claims, 3 Drawing Sheets

MANHOLE COVER REMOVAL APPARATUS AND METHOD

BACKGROUND OF THE INVENTION

1. Field of the Invention

This invention relates generally to the field of metallic manhole covers of a type removably mounted with a hole accessing an enclosure.

More particularly, this invention relates to an apparatus for removing a metallic manhole cover.

In a further and more specific aspect, the present invention relates to a vehicle and apparatus for removing a metallic manhole cover.

2. Prior Art

Metallic manhole covers are commonly found in the streets and roads throughout most cities and other municipalities throughout most of the industrialized world. Manhole covers normally enclose holes or openings accessing underground enclosure or structures operating as sewer and drainage systems or to house other Public Utilities. Because sewer and drainage systems and other Public Utilities housed within such enclosures, manhole covers must often be removed for allowing workers to access the enclosures through the holes. Because manhole covers are extremely heavy and cumbersome to move, removing manhole covers has long been a difficult and arduous task. Although the prior art has provided a variety of apparatus, such as cranes and the like, for engaging and lifting heavy and cumbersome items, little has been done to provide for the easy and efficient removal of metallic manhole covers.

It would be highly advantageous, therefore, to remedy the foregoing and other deficiencies inherent in the prior art.

Accordingly, it is an object of the present invention to provide an apparatus for removing manhole covers.

Another object of the present invention is to provide an apparatus for removing manhole covers for use with a vehicle of a type having a body carried by a wheeled chassis.

And another object of the present invention is to provide an apparatus that is easy to construct.

Still another object of the present invention is to provide an apparatus that is easy to use.

Yet another object of the instant invention is to provide an apparatus that is easy to install with a vehicle of a type having a body carried by a wheeled chassis.

Yet still another object of the instant invention is to provide an apparatus that is inexpensive.

And a further object of the invention is the provision of eliminating the difficult and frustration commonly associated with removing manhole covers.

Still a further object of the immediate invention is the provision of providing a safe and efficient means for removing manhole covers.

Yet a further object of the invention is to provide an apparatus that may be installed with a vehicle of a type having a body carried by a wheeled chassis without modifying the vehicle.

And still a further object of the invention is to provide a new and improved method of removing a manhole cover.

SUMMARY OF THE INVENTION

Briefly, to achieve the desired objects of the instant invention in accordance with a preferred embodiment thereof, provided is a vehicle for removing a metallic manhole cover from a hole accessing an enclosure. The vehicle is generally comprised of a wheeled chassis, a body carried by the wheeled chassis, a gripping member carried by the vehicle for movement in reciprocal directions between an extended position to grasp the manhole cover and a retracted position to remove the manhole cover from the hole, and a drive assembly mounted with the vehicle and the gripping member for moving the gripping member in reciprocal directions.

In a particular embodiment, the drive assembly may be comprised of a hydraulic cylinder carried by the vehicle and an operating rod mounted partially within the hydraulic cylinder for movement in reciprocal directions and with the gripping member, the gripping member movable in reciprocal directions upon movement of the operating rod in reciprocal directions. In another embodiment, the drive assembly may be comprised of a housing carried by the vehicle, a shaft carried by the housing for movement in reciprocal directions and a pinion. The shaft is preferably elongate and includes a first end, a second end mounted with the gripping member and a plurality of teeth extending substantially from the first end to the second end, the pinion being carried by the housing for rotation and for gearing with the teeth for imparting reciprocal movement to the shaft.

In a preferred embodiment, the gripping member includes an electromagnet operative for magnetically gripping the manhole cover. In this regard, the vehicle may further include an electric power source, such as a battery or an electric motor, coupled with the electromagnet in electrical communication for providing electrical power to the electromagnet. The vehicle may still further include a switch coupled with the electric power source and the electromagnet and movable between an open position to charge the electromagnet to grasp the manhole cover in the extended position of the electromagnet and a closed position to de-charge the electromagnet.

To actuate the drive assembly, the present invention may further include a controller coupled with the drive assembly for actuation to selectively actuate the drive assembly for moving the gripping member in reciprocal directions.

Consistent with the foregoing, associated methods may also be provided.

BRIEF DESCRIPTION OF THE DRAWINGS

The foregoing and further and more specific objects and advantages of the present invention will become readily apparent to those skilled in the art from the following detailed description thereof taken in conjunction with the drawings in which.

DETAILED DESCRIPTION OF THE PREFERRED EMBODIMENT

The present invention provides, among other things, an apparatus and method for removing metallic manhole covers. The apparatus is generally intended to be used with a motorized vehicle for providing easy and efficient transport and for providing an easy and efficient means of removing metallic manhole covers.

Figure 1:
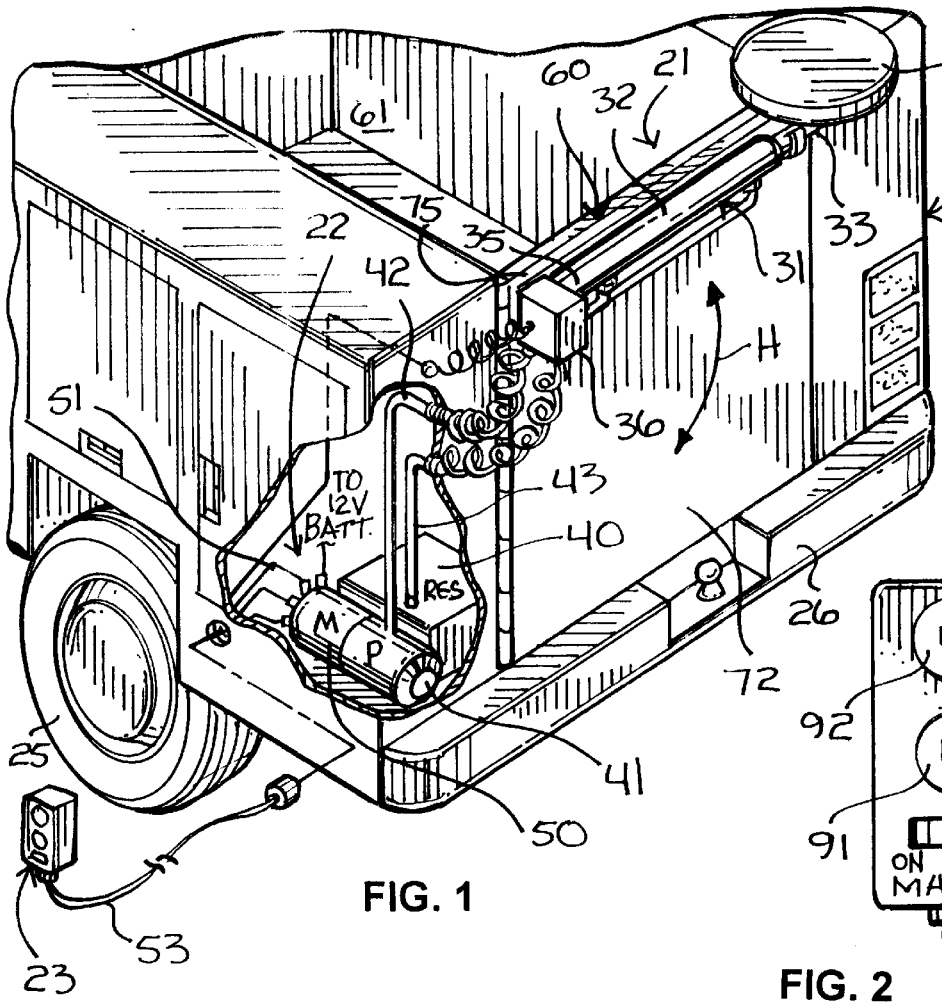
FIG. 1 illustrates a vehicle having an apparatus for removing a metallic manhole cover, with portions of the vehicle being broken away to illustrate a drive assembly coupled with a controller for operating the apparatus, in accordance with a preferred embodiment of the present invention.

Turning now to the drawings, in which like reference characters indicate corresponding elements throughout the several views, attention is first directed to FIG. 1 illustrating a vehicle 20 having an apparatus 21 for removing a metallic manhole cover, with portions of vehicle 20 being broken away to illustrate a drive assembly 22 coupled with a controller 23 for operating apparatus 21, in accordance with a preferred embodiment of the present invention. Vehicle 20 is preferably of a type including a body 24 carried by a wheeled chassis 25, vehicle 20 being motorized such as by an internal combustion engine or perhaps an electrically powered motor. For the purposes of orientation, vehicle 20 is generally considered to have a rear or downstream end 26.

Figure 3:
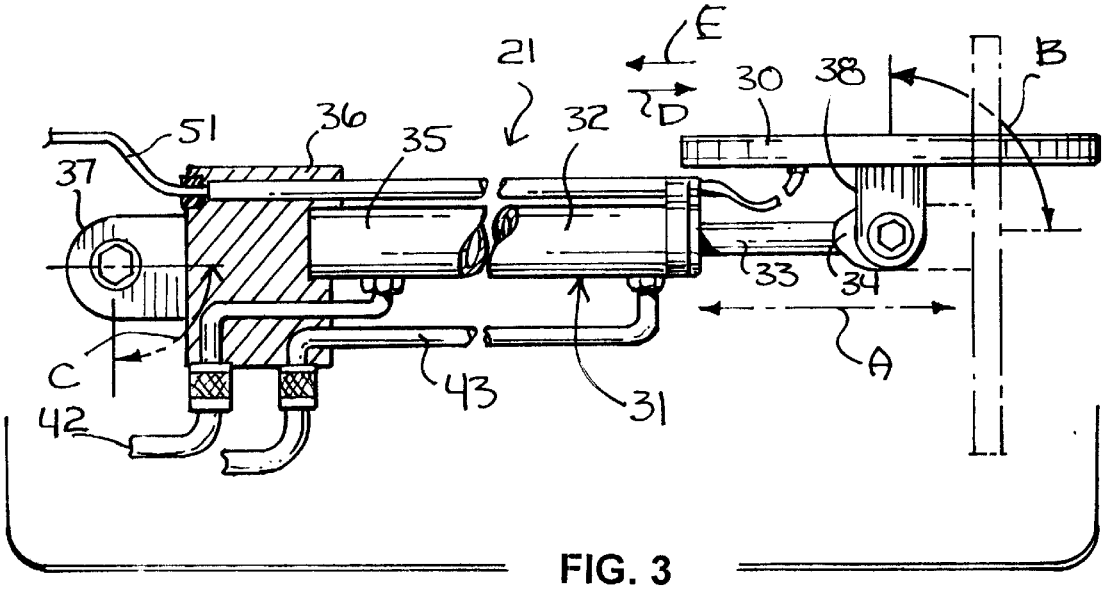
FIG. 3 illustrates a side elevational view of the apparatus of FIG. 1.

In the embodiment set forth in FIG. 1, apparatus 21 is generally comprised of an engagement or gripping member 30 mounted with, in this specific example, a cylinder assembly 31 carried by body 24 at rear end 26 of vehicle 20. With attention directed to FIG. 3 illustrating a side elevational view of apparatus 21, cylinder assembly 31 is hydraulically operated and includes a cylinder 32 and an operating rod 33 mounted partially within cylinder 32 for movement in reciprocal directions between retracted and extended positions as generally indicated by the double arrowed line A, operating rod 33 terminating outwardly from cylinder 32 with a free end 34 mounted with gripping member 30. In the embodiment set forth in FIG. 3, gripping member 30 is preferably mounted with free end 34 for pivotal movement as generally indicated by the double arrowed line B such as by U-joint 38.

Cylinder 32 further includes an end 35 coupled with a housing 36 mounted with body 24 for pivotal movement as generally indicated by the double arrowed line C in FIG. 3 such as with bracket 37. Carried by vehicle 20 at a substantially elevated position as shown in FIG. 1, cylinder assembly 31 and gripping member 30 are both operably coupled with drive assembly 22 operative for actuating cylinder assembly 31 and gripping member 30 in a manner to be discussed presently. As set forth in FIG. 1, drive assembly 22 is housed within body 24 toward rear end 26 and is first generally comprised of a reservoir 40 for carrying hydraulic fluid or oil, and a hydraulic pump 41 coupled in hydraulic fluid communication with reservoir 40. Pump 41 is in turn coupled in hydraulic fluid communication with cylinder 32 by virtue of supply line 42 that extends outwardly from pump 41 and into and through housing 36 for receipt by cylinder 32. Consistent with the foregoing, reservoir is in turn coupled in hydraulic fluid communication with cylinder by virtue of return line 43 that extends outwardly from cylinder 32 and into and through housing for receipt by reservoir 40. In accordance with conventional hydraulic cylinder assemblies of the type herein set forth, pump 41 may be actuated for pushing hydraulic fluid into cylinder 32 through supply line to push operating rod 33 outwardly in the direction indicated by the arrowed line D in FIG. 3, and for pulling hydraulic fluid from cylinder 32 through return line 43 and into reservoir 40 to pull operating rod 33 inwardly into cylinder 32 in the direction indicated by the arrowed line E.

Figure 5:
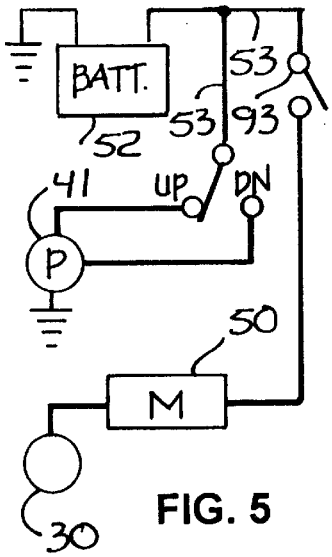
FIG. 5 illustrates a circuit for providing electrical power to the apparatus of FIG. 1.

Regarding a preferred embodiment of the present invention, and with continuing reference to FIG. 1, drive assembly 22 is further comprised of an electric motor 50 carried with pump 41 and coupled with gripping member 30 in electrical communication by virtue of electrical interconnection 51 extending outwardly from motor 50 and into and through housing 36 for receipt by gripping member 30. Electric motor 50 is of a conventional and readily available sort well known to the skilled artisan. In this regard, and with attention directed to FIG. 5, motor 50 may be coupled with a power source, such as a battery 52, via electrical interconnection 53 for providing electrical power to motor 50 during normal operation, further details to be discussed as the detailed description ensues.

Gripping member 30 is preferably provided as a conventional and readily available electromagnet. In this regard, and through the selected operation of drive assembly 22, motor 50 may be actuated for providing electrical power to charge gripping member 30 to create a magnetic field of sufficient strength to allow gripping member 30 engage, grip and hold a metallic manhole cover, further details to be discussed as the detailed description ensues.

Regarding the embodiment set forth in FIG. 1, housing 36 is shown mounted with a gate assembly 60 carried by vehicle 20 and operative for allowing access to an enclosure 61 bound by body 24 toward the rear end 26 of vehicle 20. Best shown in FIG. 3B, gate assembly 60 is generally comprised of first linkage or gate element 70 having a proximal end 71 mounted with body 24 for movement along lateral pivotal traverse relative vehicle 20 as generally indicated by the double arrowed line F (shown also in FIG. 3A), and a second linkage or gate element 72 having an end 73 mounted with a distal end 74 of first linkage element 70 for movement along lateral pivotal traverse relative first linkage element 70 as generally evinced by the double arrowed line G, second linkage element 72 terminating outwardly with a free end 75. In this regard, gate assembly 60 may be moved between a closed or retracted position to bound an opening into enclosure 61, and an open or extended position along lateral pivotal traverse of the first and second linkage elements 70 and 72 outwardly from vehicle 20 to allow access through opening 76 as seen in FIGS. 3A–3C into enclosure 61.

Figure 3D:
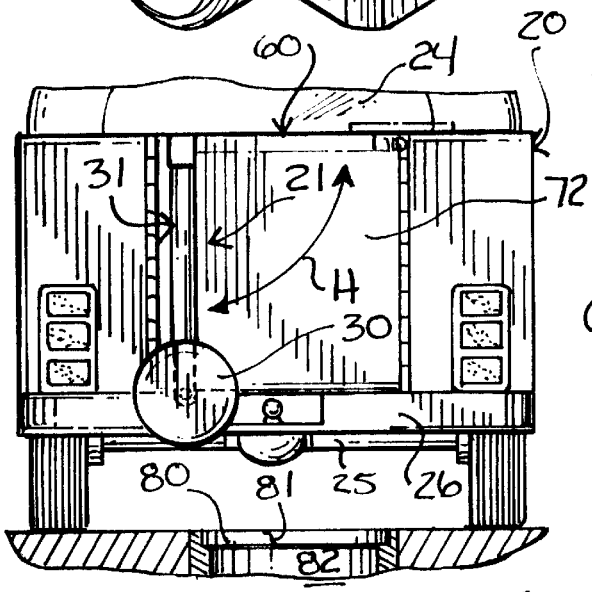
FIG. 3D illustrates a view very similar to the view of FIG. 3C further illustrating the apparatus being deployed from the third configuration into a fourth configuration in a fourth phase of operation
Figure 3A:
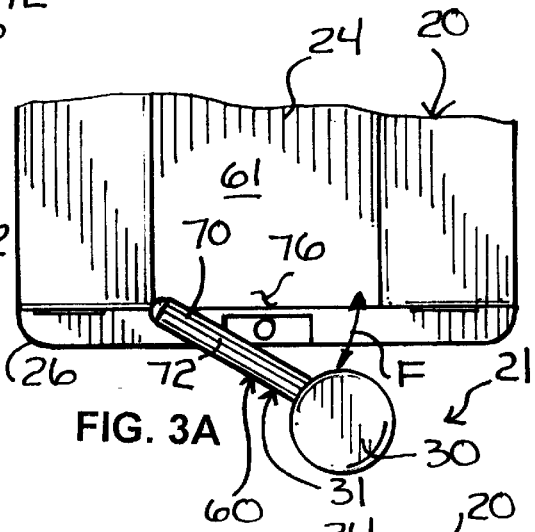
FIG. 3A illustrates a top elevational view of the apparatus of the present invention shown as it would appear being deployed into a first configuration in a first phase of operation.

As shown in FIG. 1, housing 36 is shown mounted with second linkage element 72 at free end 75 for movement of apparatus 21 along lateral pivotal traverse along a plane substantially transverse to second linkage element 72 as generally indicated by the double arrowed line H from a stored or substantially horizontal position to, as shown in FIG. 3D, an operative or substantially vertical position, the double arrowed line H also being shown in FIG. 3D.

In operation, rear end 26 vehicle 20 may be positioned, such as by driving vehicle 20, adjacent a metallic manhole cover 80 of a type set forth in FIG. 3D removably mounted with a hole 81 formed through, for instance, a road and accessing an enclosure 82. From the closed position of gate assembly 60, first linkage element 70 may be moved outwardly along lateral pivotal traverse away from vehicle 20 to deploy apparatus 21 into a first configuration in a first phase of operation. From the first configuration, second linkage element 72 may then be moved outwardly from first linkage element 70 about end 73 along lateral pivotal traverse to defined the extended orientation of gate assembly 60 to deploy apparatus 21 into a second configuration in a second phase of operation.

Figure 3C:
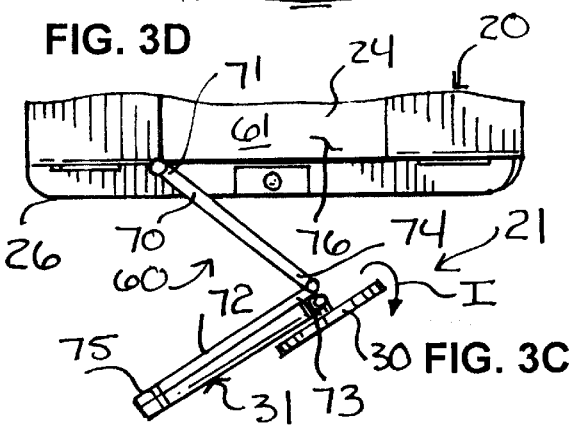
FIG. 3C illustrates a view very similar to the view of FIG. 3B further illustrating the apparatus being deployed from the second configuration into a third configuration in a third phase of operation.
Figure 3B:
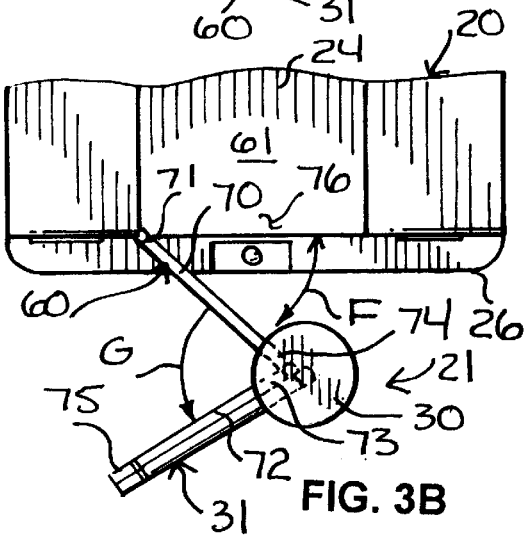
FIG. 3B illustrates a view very similar to the view of FIG. 3A further illustrating the apparatus being deployed from the first configuration into a second configuration in a second phase of operation.

With gate assembly 60 so extended as shown in FIG. 3B, gripping member 30 may be grasp and rotated outwardly from second linkage element 72 in the direction generally indicated by the arcuate arrowed line I in FIG. 3C into a third configuration of apparatus 21 in a third phase of operation, and then cylinder assembly 31 and gripping member 30 moved downwardly along lateral pivotal traverse at housing 36 from the stored or substantially horizontal position to, as shown in FIG. 3D, an operative or substantially vertical position in a fourth configuration of apparatus 21 in a fourth phase of operation.

Figure 3E:
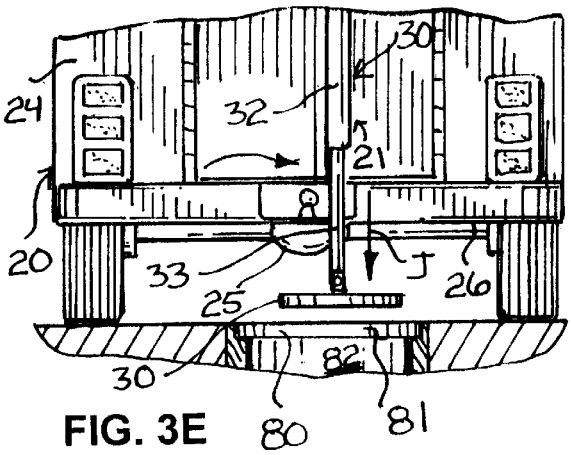
FIG. 3E illustrates a view very similar to the view of FIG. 3D further illustrating the apparatus being deployed from the fourth configuration into a fifth configuration in a fifth phase of operation to engage and grip a manhole cover for removal.

From the fourth configuration of apparatus 21, gate assembly 60 may be manipulated to position gripping member 30 in substantial opposition to manhole cover 80 as shown substantially in FIG. 3E. With gripping member 30 positioned in substantial opposition to manhole cover 80, cylinder assembly 31 may be actuated for moving operating rod 33 outwardly in the direction generally indicated by the arrowed line J in FIG. 3E from a first or retracted position in cylinder 32, to a second or extended position away from cylinder 32 to move gripping member 30 into engagement with manhole cover 80 in a fifth configuration of apparatus 21 in a fifth phase of operation.

Figure 2:
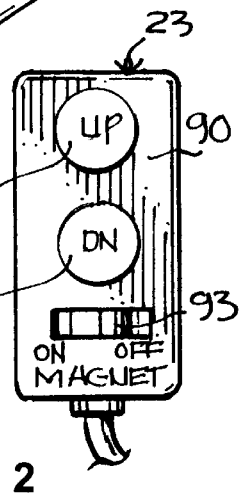
FIG. 2 illustrates an enlarged view of the controller of FIG. 1.

As previously intimated, the selected control and operation of cylinder assembly 31 and gripping member 30 may be carried out with controller 23 shown in FIG. 1 as coupled in electrical communication with electric motor 50 and pump 41 by virtue of electrical interconnection 53. As shown in FIG. 2 and with further attention directed to FIG. 5, controller 23 is mounted along electrical interconnection 53 intermediate battery and motor 50 and includes a housing 90 having an "DN" button 91 that may be selectively pressed for switching and actuating pump 41 for moving operating rod 33 into the extended position, and an "UP" button 92 that may be selectively pressed for switching and actuating pump 41 for moving operating rod 33 into the retracted position. Controller 23 further includes a switch 93, also seen in FIG. 5, movable between an "ON" position for actuating electric motor 50 for supplying electrical power to gripping member 30 to charge gripping member to create a magnetic field, and an "OFF" position for turning electric motor 50 off for de-charging gripping member 30. To this end, controller 23 may be equipped with suitable logic circuitry for facilitating selected communication with pump 41 and electric motor 50 in the foregoing manner.

Regarding the continued operation of apparatus 21, upon engagement of gripping member 30 with manhole cover 80, switch 93 may be turned to the "ON" position to actuate electric motor 50 to introduce a magnetic field to gripping member 30 for facilitating the magnetic engagement of gripping member 30 with manhole cover. So engaged, button 92 may be pressed for actuating cylinder assembly 31 for moving operating rod 33 into the retracted position for to pull manhole cover 80 away from hole 81 thus allowing desired access into enclosure 82 through hole 81. Upon removal of manhole cover 80 from hole 81 in the foregoing manner, gate assembly 60 may be pivoted as desired for moving manhole cover 80 out of the way as desired for allowing desired access to hole 81. To re-install manhole cover 80 with hole 81, the forgoing operation regarding the removal of manhole cover 80 need only be reversed.

It will be readily understood that the magnetic field supplied by gripping member 30 upon charging with electrical power supplied from electric motor 50 is of degree sufficient to allow gripping member 30 to carry manhole cover 80 in the foregoing manner of operation. Furthermore, the pivotal attachment of gripping member 30 with operating rod 33 allows gripping member 30 to be moved as desired for storage in the stored position of apparatus 21 and for operation in the operative position of apparatus 21 as shown in FIG. 3 to facilitate the desired engagement with manhole cover 80.

Figure 4:
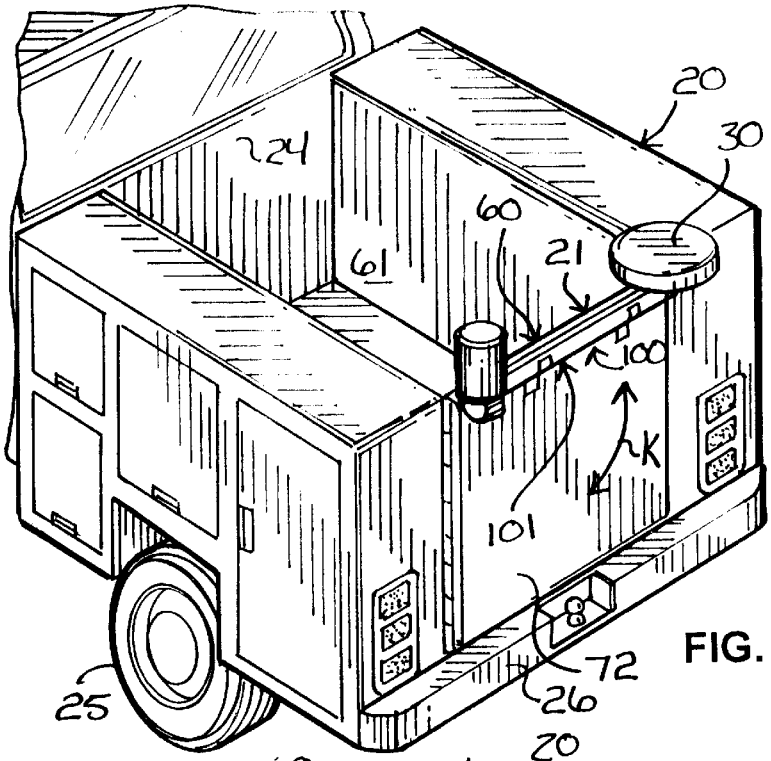
FIG. 4 illustrates a view very similar to the view of FIG. 1 showing an alternate embodiment of an apparatus for removing a metallic manhole cover.
Figure 6:
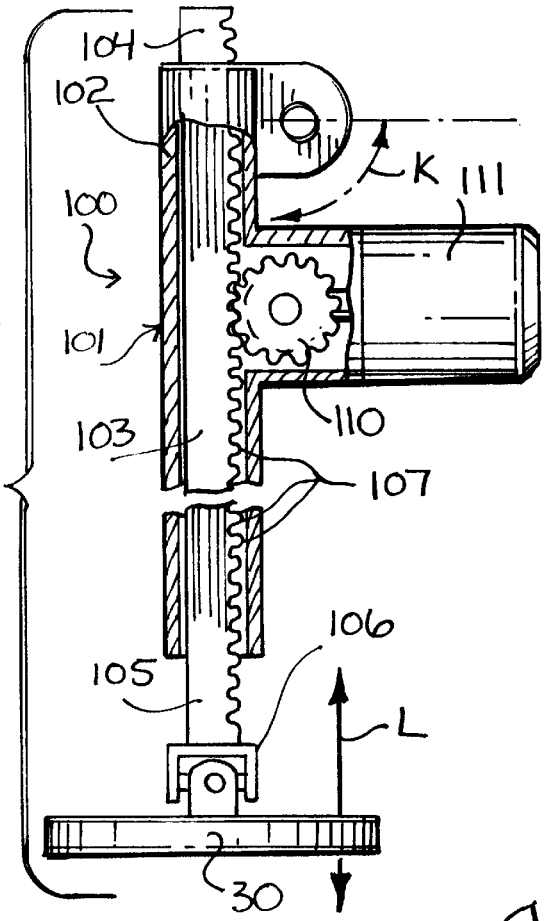
FIG. 6 illustrates a vertical sectional view of the apparatus of FIG. 4.

A variety of conventional mechanisms may be employed in combination with the present invention for providing the desired reciprocation of gripping member 30 for accomplishing the removal of manhole covers as herein discussed. In this regard, and with attention directed to FIG. 4, illustrated is a view substantially similar to the view of FIG. 1 illustrating an alternate embodiment of an apparatus 100 for removing a metallic manhole cover. Apparatus 100 includes substantially the same structural and functional features as apparatus 20, the specific details of which will not be again discussed. However, rather than having cylinder assembly 31 for providing movement of gripping member 30 in reciprocal directions, apparatus 100 sets forth a rack and pinion assembly 101 for providing the desired movement of gripping member 30 in reciprocal directions. In this regard, and with attention directed to FIG. 6 illustrating a vertical sectional view of the rack and pinion assembly 101 first introduced in combination with FIG. 4, rack and pinion assembly 101 is generally comprised of a housing 102 mounted, like housing 36 discussed in combination with apparatus 20, for pivotal movement along lateral pivotal traverse as indicated by the double arrowed line K in FIG. 4 and FIG. 6 in a plane substantially transverse to second linkage element 72 of gate assembly 60.

Further included is a rack or shaft 103 carried by housing 102 for movement in reciprocal directions as generally indicated by the double arrowed line L, shaft 103 having a first end 104, a second end 105 mounted with gripping member 30 by virtue of a U-joint 106, and a plurality of teeth 107 extending substantially from first end 104 to second end 105. A pinion 110 is also provided and carried by housing 102 for rotation and for gearing with teeth 107 for imparting reciprocal movement to shaft 103 upon rotation of pinion 110 in predetermined rotation directions in accordance with conventional rack and pinion mechanisms. To drive pinion 110 for rotation as desired for moving shaft 103 in reciprocal directions, pinion 110 may be coupled with an electric motor 111 that may be selectively actuated such as with controller 23 previously discussed in combination with apparatus 20. However, a gas-powered motor may be used in lieu of electric motor 111 if so desired.

Figure 7:
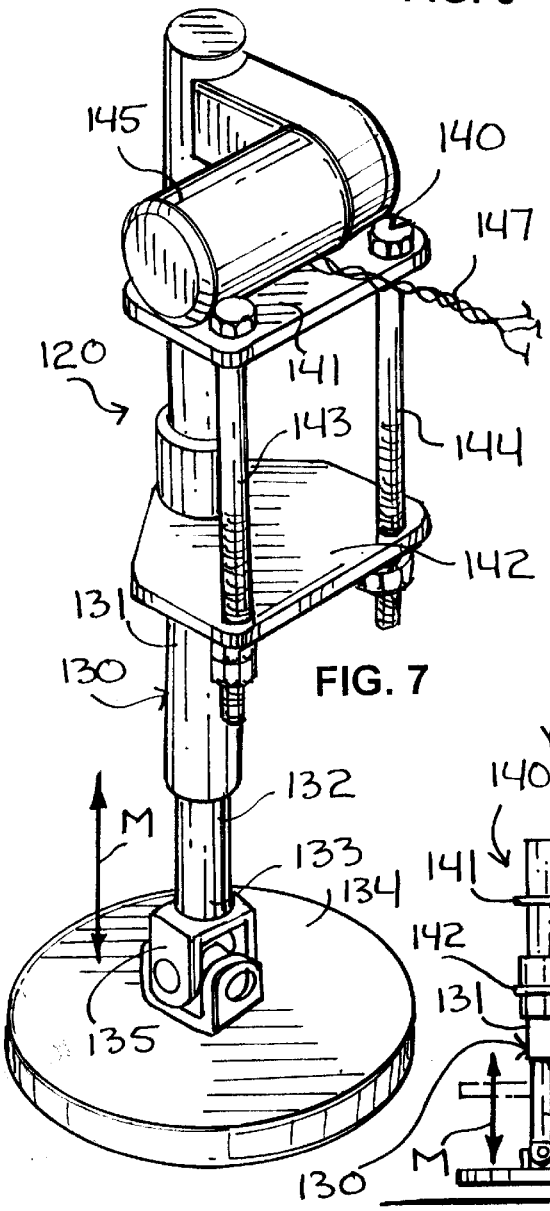
FIG. 7 illustrates yet another alternate embodiment of an apparatus for removing a metallic manhole cover.
Figure 8:
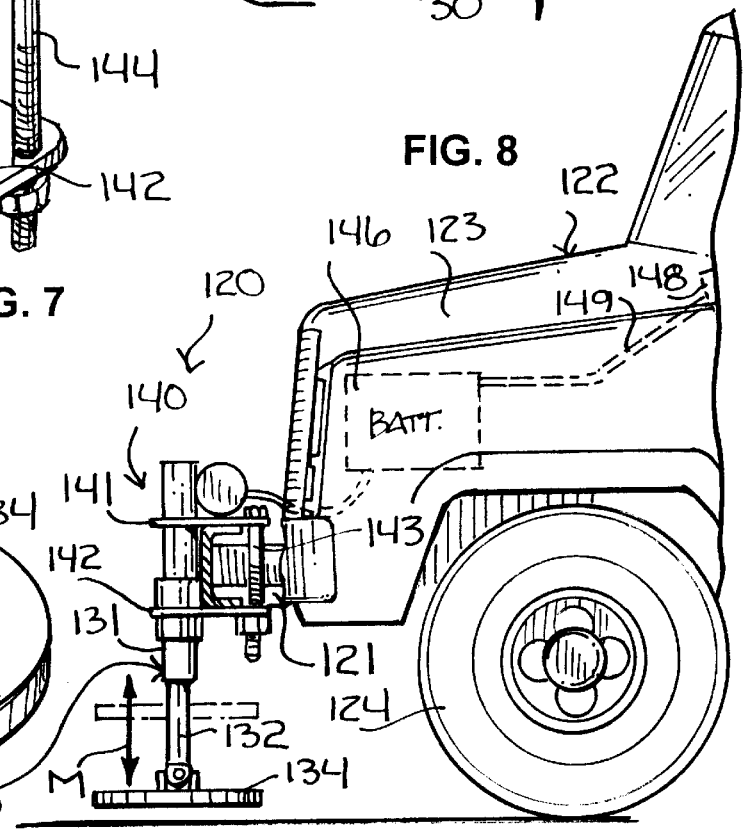
FIG. 8 illustrates the apparatus of FIG. 8 shown as it would appear carried by a vehicle in accordance with an alternate embodiment of the present invention.

Although the foregoing embodiments of the present invention have been discussed for operation in combination with gate assembly 60, FIG. 8 illustrates an alternate embodiment of an apparatus 120 for removing a metallic manhole cover shown as it would appear carried by, in this specific example, a front bumper 121 of a motorized vehicle 122 of a type including, like vehicle 20, a body 123 carried by a wheeled chassis 124. With momentary attention directed to FIG. 7, and like apparatus 20, apparatus 120 is generally comprised of a hydraulic cylinder assembly 130 including a cylinder 131 and an operating rod 132 mounted partially within cylinder 131 for movement in reciprocal directions between retracted and extended positions as generally indicated by the double arrowed line M (shown also in FIG. 8), operating rod 132 terminating outwardly from cylinder 131 with a free end 133 mounted with a gripping member 134 by virtue of a U-joint. Gripping member 134, like gripping member 30 discussed previously, is preferably comprised of an electromagnet 30.

Apparatus 120 further includes a support structure 140 mounted with cylinder 131 including first and second spaced apart and substantially opposing support members 141 and 142 interconnected with a pair of nut and bolt assemblies 143 and 144. To install apparatus with bumper 121, support structure 140 may be located with first and second support members 141 and 142 to reside on either the upper and lower ends of bumper 121 and nut and bolt assemblies 143 and 144 engaged behind bumper 121 and tightened to clamp support structure 140 with bumper 121 and thus secure apparatus 120 with bumper 121 as shown in FIG. 8 with apparatus 120, in this specific example, shown extending outboard of bumper 121.

So installed, vehicle 122 may be positioned, such as by driving, to locate gripping member 134 in substantial opposition to a metallic manhole cover and then apparatus 120 actuated in a manner substantially similar to apparatus 20, to engage and remove the manhole cover. So removed, vehicle 122 may then be driven away for allowing access to the hole.

As shown in FIG. 7, an electric motor 145 may be mounted with support structure 140 for providing electrical power to charge gripping member 134 for providing gripping member with a magnetic field. To this end, and with additional reference to FIG. 8, electric motor 145 may be coupled in electrical communication with a battery 146 carried by vehicle 122 by virtue of electrical interconnection 147, and to controls 147 carried by vehicle 122 by virtue of electrical interconnections 148 for allowing the selected control and operation of apparatus 120 in a manner consistent with the operation of apparatus 20 as herein previously discussed.

The present invention has been described above with reference to a preferred embodiment. However, those skilled in the art will recognize that changes and modifications may be made in the described embodiments without departing from the nature and scope of the present invention. For instance, although the gripping member of the various embodiments presented herein has been disclosed as an electromagnet, conventional magnets and mechanical magnets may, in alternate embodiments, be used in lieu thereof if so desired.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. In a vehicle of a type including a body carried by a wheeled chassis, apparatus for removing a metallic manhole cover from a hole, the apparatus comprising:

a gate mounted with the body for horizontal lateral pivotal traverse between a closed position and an open position extending away from the body; and a gripping member carried by the gate for movement in reciprocal directions between, in the open position of the gate, a first position to grasp the manhole cover and a second position to remove the manhole cover from the hole.

2. The apparatus of claim 1, further including a drive assembly mounted with the body and the gripping member for moving the gripping member in reciprocal directions.

3. The apparatus of claim 2, wherein the drive assembly comprises a hydraulic drive assembly including:

a cylinder having an end mounted with the gate; and an operating rod mounted partially within the cylinder for movement in reciprocal directions and a free end mounted with the gripping member, the gripping member movable in reciprocal directions upon actuation of the operating rod in reciprocal directions.

4. The apparatus of claim 2, wherein the drive assembly includes:

a housing mounted with the gate;

a shaft carried by the housing for movement in reciprocal directions, the shaft having a first end, a second end mounted with the gripping member and a plurality of teeth extending substantially from the first end to the second end; and a pinion carried by the housing for rotation and for gearing with the teeth for imparting reciprocal movement to the shaft.

5. The apparatus of claim 2, further including a controller coupled with the drive assembly for actuation to selectively actuate the drive assembly for moving the gripping member in reciprocal directions.

6. The apparatus of claim 2, wherein the drive assembly is mounted with the gate for movement between a substantially horizontal position along lateral pivotal traverse to a substantially vertical position, wherein in the substantially vertical position, the gripping member may be moved in reciprocal directions between the first and second positions to grasp and remove the manhole cover from the hole.

7. The apparatus of claim 1, wherein the gripping member includes an electromagnet.

8. The apparatus of claim 7, further including an electric power source coupled with the electromagnet in electrical communication for providing electrical power to the electromagnet.

9. The apparatus of claim 8, further including a switch coupled with the electric power source and the electromagnet and movable between first and second positions for charging and de-charging the electromagnet.

10. The apparatus of claim 8, wherein the electric power source includes a battery carried by the body.

11. The apparatus of claim 8, wherein the electric power source includes an electric motor carried by the body.

12. In a vehicle of a type including a body carried by a wheeled chassis, apparatus for removing a metallic manhole cover from a hole, the apparatus comprising:

a drive assembly mounted to and extending beyond an end of the vehicle;

a gripping member carried by the drive assembly for movement in reciprocal directions between a first position to grasp the manhole cover and a second position to remove the manhole cover from the hole; and the drive assembly is mounted with the vehicle for movement between a substantially horizontal position along lateral pivotal traverse to a substantially vertical position, wherein in the substantially vertical position, the gripping member may be moved in reciprocal directions between the first and second positions to grasp and remove the manhole cover from the hole.

* * * * *